US010470508B2

(12) United States Patent
O'Connor et al.

(10) Patent No.: US 10,470,508 B2
(45) Date of Patent: Nov. 12, 2019

(54) POCKET FOR AUTOMATIC RETRIEVAL OF PERSONAL ITEMS

(71) Applicant: VANS, INC., Cypress, CA (US)

(72) Inventors: Colin Carroll O'Connor, Calgary, CA (US); Jay Anthony Pezzelle, Long Beach, CA (US); Kris David Bergeron, Costa Mesa, CA (US)

(73) Assignee: Vans, Inc., Costa Mesa, CA (US)

( * ) Notice: Subject to any disclaimer, the term of this patent is extended or adjusted under 35 U.S.C. 154(b) by 225 days.

(21) Appl. No.: 15/409,098

(22) Filed: Jan. 18, 2017

(65) Prior Publication Data

US 2018/0199645 A1 Jul. 19, 2018

(51) Int. Cl.

| | |
|---|---|
| ***A45C 11/00*** | (2006.01) |
| ***A41D 27/20*** | (2006.01) |
| ***A45F 5/02*** | (2006.01) |

(52) U.S. Cl.

CPC ..... *A41D 27/205* (2013.01); *A45C 11/00* (2013.01); *A45F 5/022* (2013.01); *A45C 2011/001* (2013.01); *A45C 2011/002* (2013.01)

(58) Field of Classification Search

CPC . A41D 27/205; A45C 11/00; A45C 2011/001; A45C 2011/002; A45C 2011/003; A45F 5/02; A45F 2200/0516

See application file for complete search history.

(56) References Cited

U.S. PATENT DOCUMENTS 2,020,797 A * 11/1935 Pabst, Jr. ..... A45C 11/18 150/149
5,174,482 A * 12/1992 Rogers ..... F42B 39/02 221/185

(Continued)

FOREIGN PATENT DOCUMENTS

| | | |
|---|---|---|
| CN | 205125108 | 4/2016 |
| CN | 105900410 | 8/2016 |

(Continued)

OTHER PUBLICATIONS

Korean Office Action for Korean Application No. 10-2018-0005986, dated Jul. 11, 2018, with translation into English, office action and translation totaling 12 pages.

(Continued)

*Primary Examiner* — Corey N Skurdal
(74) *Attorney, Agent, or Firm* — Ganz Pollard, LLC

(57) ABSTRACT

A pocket for a garment comprising a compartment having a top opening, two opposing sidewalls, and a bottom wall; a cradle having a support portion configured to receive an item; and a retainer having opposing first and second ends attached to corresponding first and second anchor areas on opposite sides of the compartment, the first end being detachable from the first anchor area, and when both opposing ends are attached to their corresponding anchor areas, the retainer spans the top opening so as to retain the item in the compartment; wherein the support portion is movable from a first raised, unbiased position to a second recessed, biased position so that when the item is supported in the cradle in the second position, an ejection force is applied to the item when the first end is detached from the first anchor area, causing the cradle to move toward the first position.

19 Claims, 7 Drawing Sheets

(56) References Cited

U.S. PATENT DOCUMENTS

| | | | | |
|---|---|---|---|---|
| 6,202,908 | B1 * | 3/2001 | Groover | F42B 39/02 224/236 |
| 6,401,642 | B1 | 6/2002 | Handte et al. | |
| 7,918,371 | B2 * | 4/2011 | Wilson | F42B 39/02 224/196 |
| 8,317,067 | B2 | 11/2012 | Lewis | |
| 8,418,267 | B2 | 4/2013 | Shaw et al. | |
| 8,745,768 | B1 | 6/2014 | Moghaddas | |
| 9,247,776 | B1 | 2/2016 | Kim | |
| 2008/0277436 | A1 | 11/2008 | Wilson | |
| 2014/0259297 | A1 | 9/2014 | Garabedian | |
| 2015/0205327 | A1 | 7/2015 | Daley, III | |
| 2016/0360863 | A1 | 12/2016 | Paduano et al. | |

FOREIGN PATENT DOCUMENTS

| | | |
|---|---|---|
| DE | 102008013524 | 10/2008 |
| JP | 2002363812 | 12/2002 |

OTHER PUBLICATIONS

Extended European Search Results for European Application No. 18151406.8, dated Sep. 7, 2018, 7 pages.
Notice of Final Rejection with English Summary, in Korean Application No. 10-2018-0005986, dated Jan. 11, 2019, 5 total pages.
Chinese Office Action in Chinese Application No. 2018100475954, dated Apr. 17, 2019, 5 pages.

* cited by examiner

POCKET FOR AUTOMATIC RETRIEVAL OF PERSONAL ITEMS

BACKGROUND

The inventive subject matter is generally directed to a pocket. More particularly, it is directed to a pocket for a garment that is designed for automatically accessing personal items such as a phone (e.g., a smartphone), a camera, a media player, batteries, digital storage drives, handheld GPS devices, two-way radios, wallets, cards, hand tools, or other types of devices or items.

Electronic gadgets such as smartphones have become ubiquitous. People carry smartphones (or other types of media players) and accessories with them everywhere they go. Some people clip their smartphone to their belts for easy access. However, it also means that they are exposed rain and/or dust, and they may be easily accessible by the thieves. The clips may also break or release accidentally, and the device falls, suffering damage or loss.

Some users place their smartphone in the pocket of their clothing. However, conventional design of pocket for a garment has a number of shortcomings. For example, some pockets are not sized and/or shaped for today's smartphones and the associated accessories. When the pocket is shallow, the phone may slide out of the pocket, e.g., when the user takes certain postures or performs certain activity. While adding a zipper or other closure elements (e.g., a buttoned flap) to seal the pocket opening may help securing the phone in the pocket, it also makes the phone less accessible and creates inconvenience for the user. On the other hand, when the pocket is deep, the phone may become loose in the pocket and prone to damage of impact by other objects, and it may not be easy for the user to reach deep into the pocket to find and retrieve the phone. In addition, large pocket may increase the production cost, and compromise the aesthetic appearance of the garment. Further, most pockets are not designed to hold a smartphone while connecting it with external accessories, e.g., earplugs or other cables. Accordingly, those accessories have to be separately stored and cannot be connected to the smartphone stored in the pocket.

Therefore, there is a need for an improved design of pocket for a garment that enables easy access and safe storage of items and devices such as smart phones and other electronic gadgets.

SUMMARY

The innovations disclosed herein overcome problems in the prior art and address one or more of the aforementioned or other needs. The inventive subject matter is generally directed to a pocket for a garment for automatically accessing personal items such as a smartphone, a camera, a media player, or other types of electronic devices, while securely carrying such items. The garment may be any type of apparels including, but not being limited to, fleeces, jackets, hoodies, shirts, suits, coats, sweaters, jeans, trousers, pants, shorts, boxers, skirts, gowns, etc. In addition to garments, the pocket may be used on other articles on which pockets are placed, including backpacks, purses, luggage items, briefcases, messenger bags, etc.

In one embodiment, a pocket for a garment includes a compartment that can have a top opening, two opposing sidewalls, and a bottom wall. The pocket can have a cradle that has at least a support portion disposed in the compartment and configured to receive and support an item storable in the compartment. The pocket can also have an associated retainer. The retainer can have opposing first and second ends attached to corresponding first and second anchor areas on opposite sides of the compartment. At least the first end can be detachable from the first anchor area. When both opposing ends are attached to their corresponding anchor areas, the retainer can span at least a portion of the top opening of the compartment so as to be able to retain the item in the compartment. The support portion of the cradle can be movable from a first raised, unbiased position in the compartment to a second recessed, biased position in the compartment so that when the item is supported in the cradle in the second position, an ejection force is applied to the item when the first end of the retainer is detached from the first anchor area, causing the cradle to move toward the first position, lifting the stored item so that it is at least partially exposed from the top opening of the compartment.

In the foregoing and other embodiments, the cradle can include a sheet of one or more plies of elastic material.

In the foregoing and other embodiments, the cradle can include one or more straps or cords of elastic material.

In the foregoing and other embodiments, at least a portion of the cradle can have a net or mesh structure.

In the foregoing and other embodiments, the support portion of the cradle can rest against at least a portion of the bottom wall when the cradle is in the second position.

In the foregoing and other embodiments, the opposing sidewalls can include a first sidewall and a second sidewall. The cradle can have a first side that is coupled to the first sidewall and a second side that is coupled to the second sidewall. The support portion of the cradle can be disposed between the first and second sidewalls.

In the foregoing and other embodiments, the first side of the cradle can have a joint with the first sidewall and the joint can be spaced from the bottom wall at a height corresponding to the first position in the compartment.

In the foregoing and other embodiments, the second anchor area can be located on the second side of the cradle.

In the foregoing and other embodiments, the pocket can further include a sleeve that covers at least a portion of the second sidewall. The second side of the cradle can be movably positioned between the sleeve and the second sidewall.

In the foregoing and other embodiments, the sleeve can have a lower end that is spaced from the bottom wall at a height corresponding to the first position in the compartment.

In the foregoing and other embodiments, the retainer can include an elastic material.

In the foregoing and other embodiments, the retainer can have a body portion between the first end and the second end, and the body portion can have an adjustable length.

In the foregoing and other embodiments, the first anchor area can have a plurality of anchor locations. The first end of the retainer can be detachably attached to the first anchor area through any of the plurality of anchor locations.

In the foregoing and other embodiments, the pocket can also include one or more channels disposed on any of the opposing sidewalls, the bottom wall, and any joint formed between the sidewalls and the bottom wall. Each of the channels can be adapted to receive a cable inserting from outside the compartment and being connectable to the item stored inside the compartment.

In the foregoing and other embodiments, the pocket can be disposed inside another pocket in the garment or other article.

In the foregoing and other embodiments, the first end of the retainer can be connected to a user graspable element.

In the foregoing and other embodiments, the pocket can have two or more cradles. Each cradle can have at least a support portion disposed in the compartment, and the cradles can be configured to receive and support the stored item. The pocket can include two or more retainers. Each retainer can have opposing first and second ends attached to corresponding first and second anchor areas on opposite sides of the compartment, at least one of the opposing ends can be detachable from the corresponding anchor area, and when both opposing ends of one of the retainers are attached to their corresponding anchor areas, the retainer can span at least a portion of the top opening of the compartment so as to be able to retain the item in the compartment. The support portion of each cradle can be movable from the first position to the second position so that when the item is supported in the cradles in the second position, an ejection force is applied to the item when one of the opposing ends for each of the retainers is detached from the corresponding anchor area, causing the cradles to move toward the first position, lifting the stored item so that it is at least partially exposed from the top opening of the compartment.

In the foregoing embodiment, the first end of each retainer can be connected to a user graspable element.

In a further embodiment, a garment includes at least a panel of fabric and a pocket attached to the fabric. The pocket includes a compartment that can have a top opening, two opposing sidewalls, and a bottom wall. The pocket can have a cradle that has at least a support portion disposed in the compartment and configured to receive and support an item storable in the compartment. The pocket can also have a retainer. The retainer can have opposing first and second ends attached to corresponding first and second anchor areas on opposite sides of the compartment. At least the first end can be detachable from the first anchor area. When both opposing ends are attached to their corresponding anchor areas, the retainer can span at least a portion of the top opening of the compartment so as to be able to retain the item in the compartment. The support portion of the cradle can be movable from a first raised, unbiased position in the compartment to a second recessed, biased position in the compartment so that when the item is supported in the cradle in the second position, an ejection force is applied to the item when the first end of the retainer is detached from the first anchor area, causing the cradle to move toward the first position, lifting the stored item so that it is at least partially exposed from the top opening of the compartment.

In the foregoing embodiment, the pocket can be disposed inside another pocket in the garment.

The inventive subject matter is further directed to a method of making a pocket on a garment. The method can include selecting a panel of fabric on the garment and disposing the pocket on the selected panel of fabric. The pocket can be any of the embodiments described in the foregoing and following descriptions.

These and other embodiments are described in more detail in the following detailed descriptions and the figures. Other embodiments are contemplated in the Detailed Description below and in the appended Figures, and in the claims, as originally written or amended, the claims as such being incorporated by reference into this Summary.

The foregoing is not intended to be an exhaustive list of embodiments and features of the inventive subject matter. Persons skilled in the art are capable of appreciating other embodiments and features from the following detailed description in conjunction with the drawings.

BRIEF DESCRIPTION OF THE DRAWINGS

The appended figures show exemplary embodiments according to the inventive subject matter, unless noted as showing prior art.

DETAILED DESCRIPTION

Figure 1B:
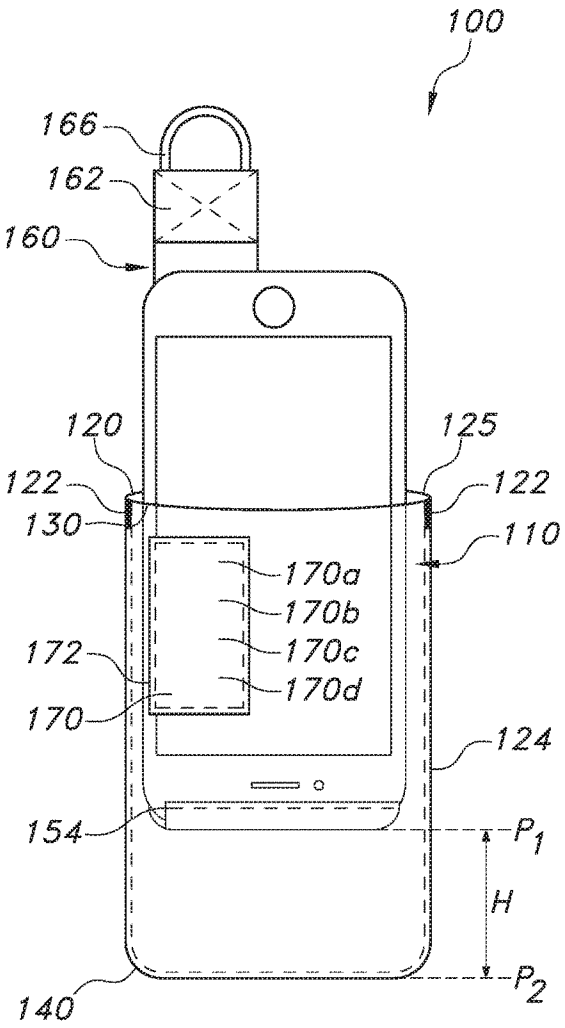
FIG. 1B shows the embodiment of the pocket containing the smartphone as in FIG. 1A, except that the support portion of the cradle is in a raised, unbiased position.

Representative embodiments according to the inventive subject matter are shown in FIGS. 1-6, wherein the same or generally similar features share common reference numerals.

Figure 1A:
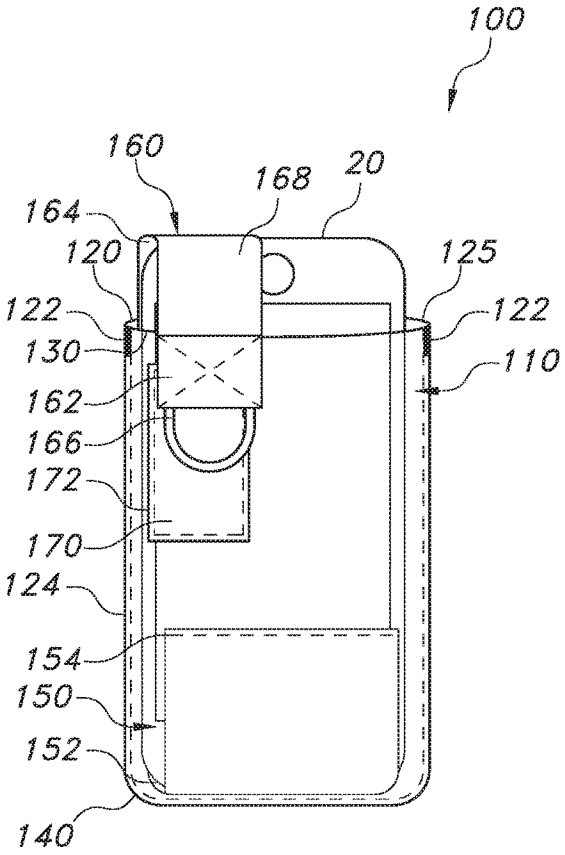
FIG. 1A shows an embodiment of a pocket containing a representative stored item, in this case a smartphone, supported by a cradle, the support portion of the cradle is in a recessed, biased position.
Figure 2:
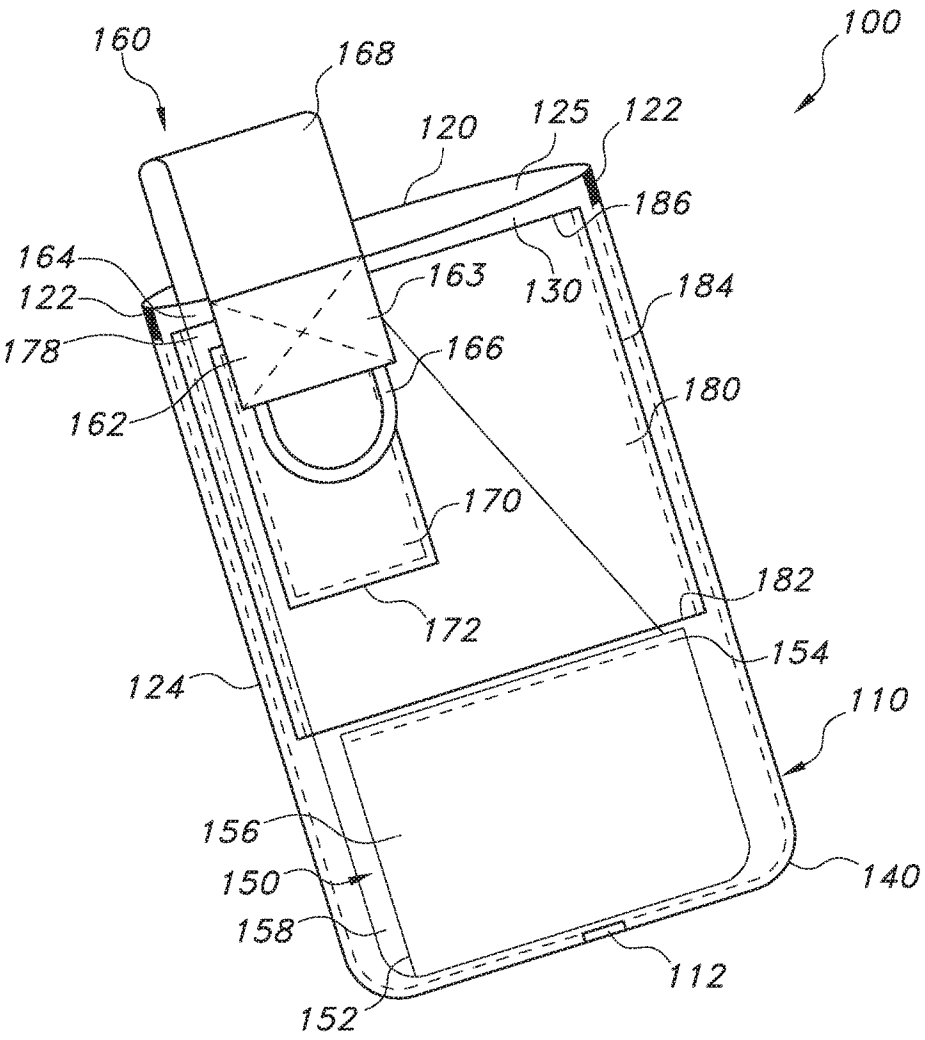
FIG. 2 shows the embodiment of the pocket as in FIGS. 1A and 1B, without displaying the smartphone contained in the pocket.

FIGS. 1-2 show one exemplary embodiment of a pocket 100 for a garment, and the pocket 100 is adapted to carry an item 20 that can be securely stored therein and is easily, automatically accessible by the user on release of a retainer. By way of illustration and without any limitation, a smartphone will be used hereafter to represent the item storable in the pocket 100 and illustrate principles of the inventive subject matter. For purposes of clarity in illustrating the structure of the pocket, the stored item (e.g., smartphone) is omitted in FIG. 2.

As illustrated in FIGS. 1-2, the pocket 100 has a compartment 110 that can have a top opening 125, two opposing sidewalls 120, 130, and a bottom wall 140. As shown in the figures, one of the opposing sidewalls can be a front sidewall 130, and the other opposing sidewall can be a rear sidewall 120. The top opening 125 can be formed between the opposing sidewalls 120, 130 near the top portion of the pocket 100, and the bottom wall 140 can join the opposing sidewalls 120, 130 near the bottom portion of the pocket 100. The sidewalls 120, 130 and/or the bottom wall 140 can be made of any kind of knit or woven or other fabric (e.g., cotton, linen, silk, etc.) that is suitable for a pocket. The fabric can be the same as or different from the material used for the garment. The pocket could also be formed of non-woven materials, such as polymer sheets or films. The sidewalls and the bottom wall can be formed as a unitary piece, or be separate pieces that are joined together, e.g., by stitches 124 around the periphery of the pocket except for the top opening 125. One or more bartacks 122 may be added in selected areas of the pocket 100, e.g., at the edge of the top opening 125, to reinforce those areas that may be subject to stress or additional wear.

The pocket 100 has a cradle 150 that includes at least a support portion 152 disposed in the compartment 110 and configured to receive and support an item 20 storable in the compartment 110. The support portion 152 of the cradle 150 can be movable in the compartment 110. Specifically, the support portion 152 of the cradle 150 can move between two positions: a first raised, unbiased position (P1) in the compartment 110, as shown in FIG. 1B, and a second recessed, biased position (P2) in the compartment 110, as shown in FIG. 1A. In some embodiments, the support portion 152 of the cradle 150 can rest against at least a portion of the bottom wall 140 when the cradle 150 is in the second position (P2). Alternatively, the support portion 152 of the cradle 150 can be spaced apart from the bottom wall 140 by a predefined height when the cradle 150 is in the second position (P2). The distance between the first position (P1) and the second position (P2), H, can be predetermined relative to the height of the compartment 110. For example, H can range between about 10% to about 50% of the height of the compartment 110. In one non-limiting example, the height of the compartment 110 may range between about 4 inches to about 8 inches, and H may range between about 1 inch to about 4 inches. However, these examples are non-limiting and other dimensions and rations may be suitable.

The pocket 100 can also have a retainer 160. The retainer 160 can have two opposing ends: a first end 162 can be attached to a first anchor area 170, and a second end 164 can be attached to a second anchor area 178. The retainer 160 can have a body portion 168 between the first end 162 and the second end 164, and the body portion 167 can have an adjustable length. For example, the body portion 167 can include an elastic material so that the retainer 160 can be stretchable. Alternatively, the body portion 167 may be formed by two pieces that can be detachably fastened together, e.g., via button(s), buckle(s), snap(s), hook and loop fasteners (e.g., VELCRO®), etc., with a varying degree of overlap to adjust the overall length.

The first anchor area 170 and the second anchor area 178 can be disposed on opposite sides of the compartment 110. The first end 162 can be detached from the first anchor area 170. For example, the attachment and detachment between the first end 162 and the first anchor area 170 may be accomplished via any kind of fastening mechanisms such as snaps, VELCRO®, button(s), buckle(s), clip(s), etc. The first anchor area 170 can be disposed outside the compartment 110. In one embodiment, the first anchor area 170 can be disposed on an outer surface of the pocket 100. For example, FIGS. 1-2 show that the first anchor area 170 can be coupled to the outer surface of the front sidewall 130 by sewing stitches 172. Alternatively, the first anchor area 170 can be disposed off the pocket 100, e.g., on a fabric of the garment that is adjacent to the pocket 100, where the first end 162 of the retainer 160 can be attached (not shown). In certain embodiments, the second anchor area 178 can be disposed on the cradle 150, or on the rear sidewall 120 of the compartment 110. In one embodiment, the second end 164 can be fixedly attached to the second anchor area 178 (e.g., by sewing stitches, etc.). In an alternative embodiment, the second end 164 can be detachably attached to the second anchor area 178, e.g., by means of zippers, snaps, VELCRO®, button(s), buckle(s), clip(s), etc.

In some embodiments, the first end 162 of the retainer 160 can be connected to a user graspable element 166, such as a hook made of a paracord or other materials. In one embodiment, as illustrated in FIGS. 1-2, the user graspable element 166 can be sewn to the first end 162 of the retainer 160 by stitches 163, and optionally reinforced by bartacks. Thus, the user can pull the user graspable element 166, stretch the retainer 160, and attach the first end 162 of the retainer 160 to the first anchor area 170. Conversely, the user can pull the user graspable element 166 to detach the first end 162 of the retainer 160 from the first anchor area 170.

In some embodiments, the first anchor area 170 can have a plurality of anchor locations. In one non-limiting example, the first anchor area 170 can have a relatively large surface area, which includes several anchor locations (e.g., 170*a*, 170*b*, 170*c*, 170*d*) where the first end 162 of the retainer 160 can be detachably attached. The anchor locations (170*a*, 170*b*, 170*c*, 170*d*) can be spatially separated or adjacent to each other on the first anchor area 170. By allowing the flexibility of connecting the first end 162 of the retainer 160 to different anchor locations (e.g., 170*a*, 170*b*, 170*c*, 170*d*), the tension and/or length of the retainer 160 can be adjusted so as to better accommodate and/or secure the item 20 stored in the compartment 110.

When both the first and second ends 162, 164 are respectively attached to the corresponding first and second anchor areas 170, 178, the retainer 160 can span at least a portion of the top opening 125. For example, FIG. 1A shows that the retainer 160 spans from the rear sidewall 120 to the front sidewall 130, and covers at least partially the top opening 125 of the compartment 110. The retainer 160 can be designed to have different widths so that it can cover various portions of the top opening 125. For example, the width of the retainer 160 can range between about 10% to about 100% of the width of the top opening 125. In one non-limiting example, the width of the top opening 125 may range between about 3 inches to about 6 inches, and the width of the retainer 160 may range between about 0.5 inch to about 1.5 inches. These are all non-limiting dimensions, and other dimensions and ratios may be suitable.

As illustrated in FIG. 1A, the retainer 160 can securely retain the item 20 in the compartment 110 when the first end 162 of the retainer 160 is attached to the first anchor area 170 located on the outer surface of the front sidewall 130. By attaching the first end 162 of the retainer 160 to the first anchor area 170, the retainer 160 can urge the item 20 sitting on the support portion 152 of the cradle 150 downward, so that the support portion 152 of the cradle 150 can be pushed toward the second recessed, biased position (P2) in the compartment 110.

When the item 20 is supported by the cradle 150 in the second recessed, biased position (P2), an upwardly directed ejection force can be applied to the item 20 when the first end 162 of the retainer 160 is detached from the first anchor area 170, causing the support portion 152 of the cradle 150 to move toward the first raised, unbiased position (P1). Thus, by simply detaching the first end 162 of the retainer 160 from the first anchor area 170, the item 20 supported by the cradle 150 can be automatically ejected upward, causing it to at least partially protrude out of the top opening 125 of the compartment 110 for easy access by the user.

In certain embodiments, the cradle 150 can include a sheet of one or more plies of elastic material, so that when the sheet is stretched (e.g., to the second position P2), a biased ejection force can be generated to return to its original length (e.g., to the first position P1). In some embodiments, the cradle 150 can include one or more straps or cords (rather than a sheet) of elastic material. In some embodiments, at least a portion of the cradle 150 can have a net or mesh structure. Besides using elastic material in the cradle 150, other mechanisms (e.g., biased spring, etc.) can also be used to eject the cradle 150 from the second recessed position P2 to the first raised position P1.

The cradle 150 can have a front part 156 and a rear part 158, and the support portion 152 can be formed between the front part 156 and the rear part 158 at the bottom of the cradle 150. The front part 156 of the cradle 150 can be coupled to the front sidewall 130 of the compartment 110. The rear part 158 of the cradle 150 can be coupled to the rear sidewall 120 of the compartment 110. The front part 156, the second side 158, and the support portion 152 of the cradle 150 can be disposed between the front sidewall 130 and the rear sidewall 120 of the compartment 110. The cradle 150, including its front part 156, rear part 158, and support portion 152, can have a uniform or non-uniform width. The width of the cradle 150 can range between about 10% to about 90% of the width of the compartment 110. In one non-limiting example, the width of the cradle 150 may range between about 2 inches to about 5.5 inches, and the width of the compartment 110 may range between about 3 inches to about 6 inches. These are all non-limiting dimensions, and other dimensions and ratios may be suitable.

In some embodiments, the front part 156 of the cradle 150 can have a joint 154 with the front sidewall 130. The joint 154 can be generally along a horizontal direction (i.e., being orthogonal to the upward and downward movement of the cradle 150). In one embodiment, the joint 154 can be formed by sewing stitches or other coupling mechanisms (e.g., zipper(s), snap(s), buckle(s), clip(s), etc.). The joint 154 can be spaced from the bottom wall 140 at a height corresponding to the first raised, unbiased position (P1) of the cradle 150 in the compartment 110. For example, the joint 154 can be spaced from the bottom wall 140 at about distance H±d1, where d1 can be a predefined tolerance of deviation, e.g., 0.5 inch.

In some embodiments, the top portion of the rear part 158 can be fixedly or detachably coupled to the rear sidewall 120 (e.g., by sewing stitches, zippers, etc.) at a location adjacent to the top opening 125 of the compartment 110. Thus, when the support portion 152 of the cradle 150 rests against the bottom wall 140, the cradle 150 can span the overall height of the compartment 110. In some embodiments, the second anchor area 178, where the second end 164 of the retainer 160 is connected, can be located on the rear part 158 of the cradle 150. In some embodiments, the second anchor area 178 can be located on the rear sidewall 120 of the compartment 110. In some embodiments, the anchor area 178 can couple both the second end 164 of the retainer 160 and the rear part 158 of the cradle 150 to the rear sidewall 120 of the compartment 110, e.g., by means of sewing stitches. Alternatively, the rear part 158 of the cradle 150 may be uncoupled to the rear sidewall 120. Accordingly, the rear part 158 of the cradle 150 is not restrained by the rear sidewall 120 and can move relatively freely up and down with respect to the compartment 110. For example, after the item 20 is ejected from the compartment 110, the user may further lift the cradle 150 upward by pulling the retainer 160.

In some embodiments, the pocket 100 can include a sleeve 180 that covers at least a portion of the rear sidewall 120 of the compartment 110. The sleeve 180 can be made of any kind of knit or woven fabric such as cotton, linen, silk, etc. The sleeve can also be made of non-woven materials, such as polymer sheets or films. The width of the sleeve 180, measured from its left edge to right edge, can be generally comparable but slightly larger than the width of the rear part 158 of the cradle 150. Thus, the rear part 158 of the cradle 150 can be accommodated between the sleeve 180 and the rear sidewall 120. The sleeve 180 can be coupled to the rear sidewall 120 on both left and right sides, while leaving the upper end 186 and lower end 182 open. For example, FIG. 2 shows that both left and right edges of the sleeve 180 are sewn to the rear sidewall 120 of the compartment 110 via edge stitches 184. Alternatively, the left and right sides of sleeve 180 can be detachably coupled to the rear sidewall 120, for example, by means of VELCRO®, zippers, snaps, etc. The upper end 186 of the sleeve 180 can be near the top opening 125 of the compartment 110. The lower end 182 of the sleeve 180 can be spaced from the bottom wall 140 at a height corresponding to the first raised, unbiased position (P1) in the compartment 110. For example, the lower end 182 can be spaced from the bottom wall 140 at about distance H±d2, where d2 can be a predefined tolerance of deviation, e.g., 0.5 inch. By coupling the left and right edges of the sleeve 180 to the rear sidewall 120 while leaving the upper end 186 and lower end 182 open, the rear part 158 of the cradle 150 can move along the vertical direction between the sleeve 180 and the rear sidewall 120. For example, when the support portion 152 of the cradle 150 is in the first recessed position (P1), the rear part 158 of the cradle 150 can stretch and/or slide downward between the sleeve 180 and the rear sidewall 120. Conversely, when the support portion 152 of the cradle 150 is in the second raised position (P2), the rear part 158 of the cradle 150 can recoil and/or slide upward between the sleeve 180 and the rear sidewall 120. In addition, the lower end 182 of the sleeve 180, together with the joint 154 can function as stoppers that limit the upward movement of the support portion 152 of the cradle 150.

In some embodiments, the pocket 100 can also include one or more channels 112 disposed on any of the sidewalls 120, 130, the bottom wall 140, and any joint formed between the sidewalls 120, 130 and the bottom wall 140. Each of the channels 112 can be adapted to receive a cable inserting from outside the compartment 110 and being connectable to the item 20 stored inside the compartment 110. For example, one of the channels 112 can be sized and/or positioned to receive an earplug cable that can connect an earplug located outside the compartment 110 to a smartphone stored in the compartment 110. In another example, one of the channels 112 can be sized and/or positioned to receive a power cord cable that can connect a battery charger located outside the compartment 110 to a smartphone stored in the compartment 110. In addition to channels, a compartment may also include or be associated with an electronics interface, such as a USB port for placing a stored device in electrical communication with other features, such as batteries, display screens, digital storage devices, earphones, and other devices, optical devices, such as virtual reality or augmented reality headsets, etc.

Figure 3:
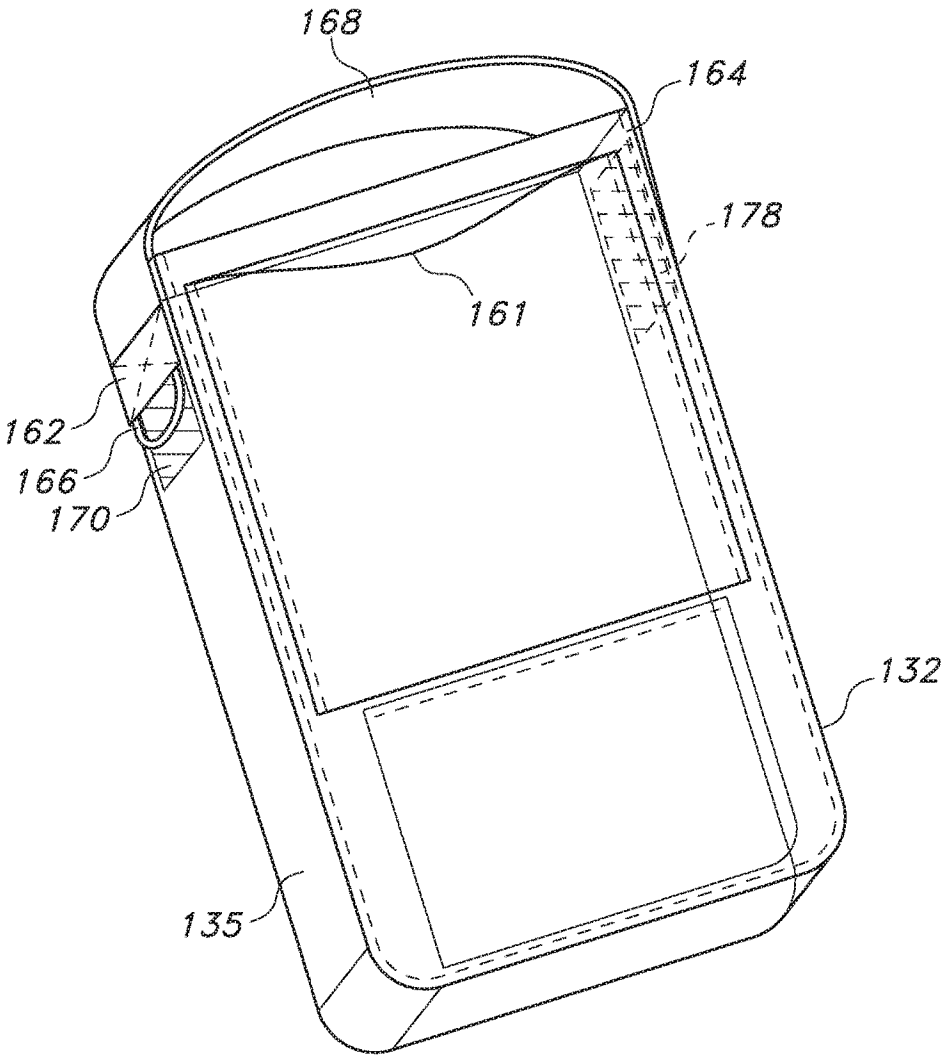
FIG. 3 shows another embodiment of a pocket as a variant of the one shown in FIG. 2.

FIG. 3 shows an alternative embodiment according to the inventive subject matter. In this embodiment, the pocket 100 can have a relatively wide space between the front sidewall 130 and the rear sidewall 120. Accordingly, the pocket 100 may also have a pair of opposing left and right sidewalls 132, 134 that respectively connect the front sidewall 130 and the rear sidewall 120 at the left and right sides of the compartments. As shown in FIG. 3, the retainer 160 can span from the left sidewall 132 to the right sidewall 134, instead of from the rear sidewall 120 to the front sidewall 130 as shown in FIGS. 1-2. Accordingly, the opposing ends (162, 164) of the retainer 160 can be respectively attached to the corresponding first and second anchor areas (170, 178) that are located on the opposing left and right sidewalls (132, 134) of the compartment 110. In an alternative embodiment, the first and second anchor areas (170, 178) can be located on the opposing left and right sides of the front sidewall 130 and/or the rear sidewall 120. Similarly, the opposing ends (162, 164) of the retainer 160 can be respectively attached to the corresponding first and second anchor areas (170, 178) that are located on the opposite left and right sides of the pocket 100. In some embodiments, the retainer 160 can have a flap 161 that helps covering the top opening 125 and securing the item 20 in the compartment 110.

Figure 4:
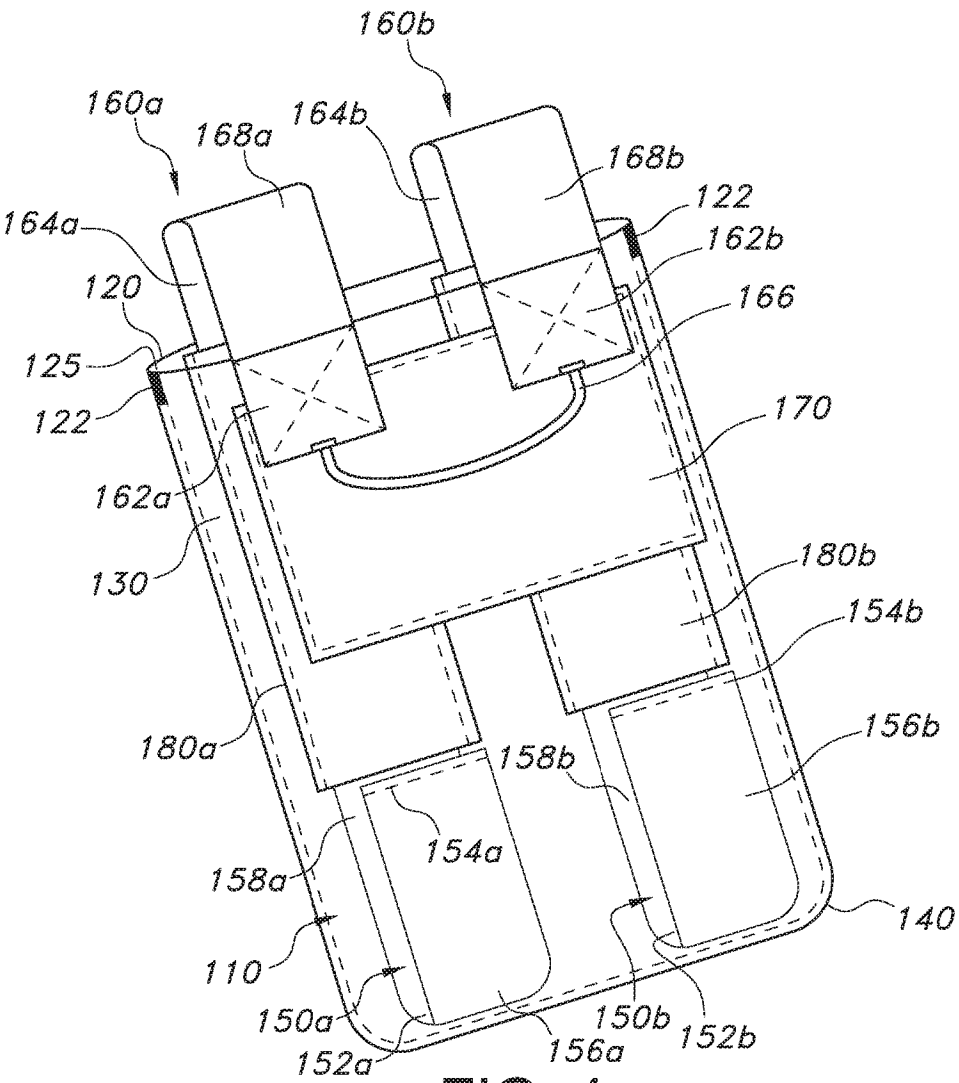
FIG. 4 shows a further embodiment of a pocket having two cradles.

FIG. 4 shows another embodiment according to the inventive subject matter. In this embodiment, the pocket 100 has two cradles 150*a* and 150*b* arranged in parallel, instead of one cradle 150 as shown in FIGS. 1-3. Similar to the cradle 150 described above, each of the cradles 150*a* and 150*b* has a corresponding support portion 152*a*, 152*b* configured to receive and support an item 20 storable in the compartment 110. The pocket 100 can also have more than one retainers, such as the two retainers 160*a*, 160*b* corresponding to the cradles 150*a*, 150*b*, respectively. Each retainer (160*a*, 160*b*) can have opposing first end (162*a*, 162*b*) and second ends (164*a*, 164*b*), which can be attached to a corresponding first anchor area (170) and second anchor area(s) (not shown) that are located on opposite sides of the compartment 110. One of the opposing ends (e.g., the first end 162*a*, 162*b*) can be detached from the corresponding anchor area (e.g., the first anchor area 170). When both the opposing ends of one the retainers (160*a*, 160*b*) are attached to their corresponding anchor areas, that retainer can span at least a portion of the top opening 125 of the compartment 110 so as to be able to retain the item 20 in the compartment 110. Similarly, the support portion (152*a*, 152*b*) of each cradle (150*a*, 150*b*) can be movable from a first raised, unbiased position (P1) in the compartment 110 to a second recessed, biased position (P2) in the compartment 110 so that when the item 20 is supported in the cradles (150*a*, 150*b*) in the second position (P2), an ejection force is applied to the item 20 when one of the opposing ends (e.g., the first end 162*a*, 162*b*) for each of the retainers (160*a*, 160*b*) is detached from the corresponding anchor area (e.g., 170), causing the cradles (150*a*, 150*b*) to move toward the first position (P1), lifting the stored item 20 so that it is at least partially exposed from the top opening 125 of the compartment 110. The first end (162*a*, 162*b*) of each retainer (160*a*, 160*b*) can be connected to a user graspable element 166. In addition, each cradle (150*a*, 150*b*) can have a front part (156*a*, 156*b*) and a rear part (158*a*, 158*b*). The front part (156*a*, 156*b*) of each cradle (150*a*, 150*b*) can be coupled to the front sidewall 130 at a corresponding joint (154*a*, 154*b*), which can be spaced from the bottom wall 140 at a height corresponding to the first position (P1) in the compartment 110. Each cradle (150*a*, 150*b*) can have a corresponding sleeve (180*a*, 180*b*) that is coupled to the rear sidewall 120, so that the rear part (158*a*, 158*b*) of the cradle (150*a*, 150*b*) can be movably positioned between the corresponding sleeve (180*a*, 180*b*) and the rear sidewall 120.

Figure 5:
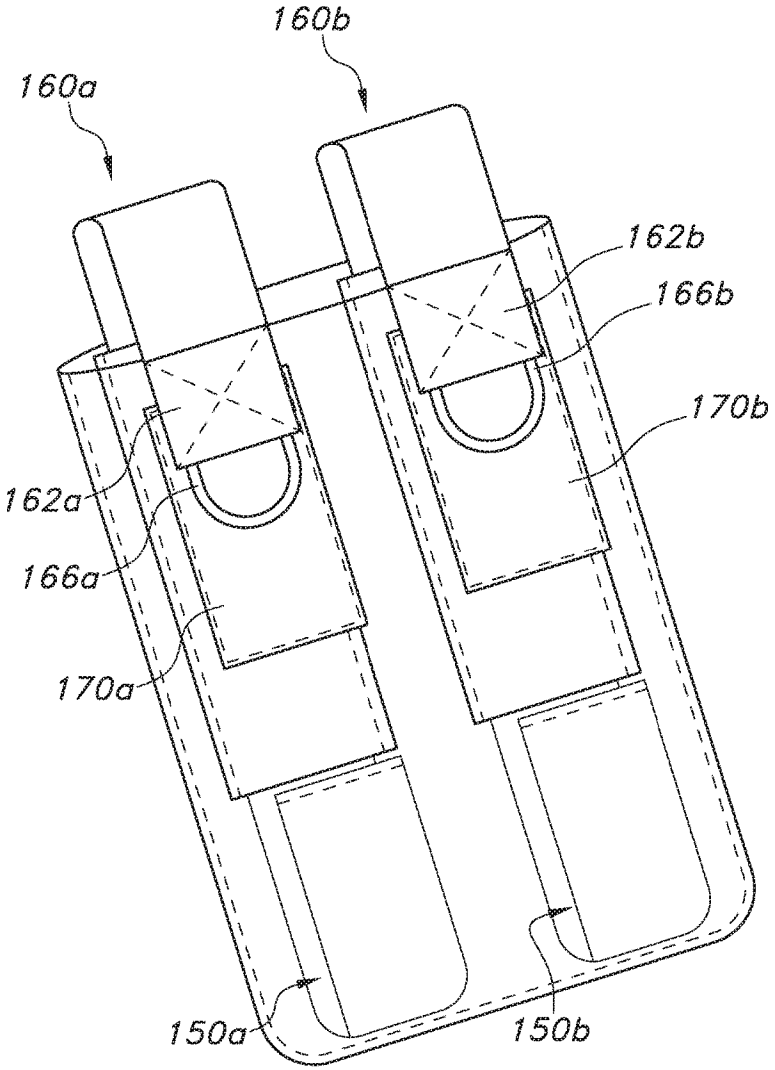
FIG. 5 shows another embodiment of a pocket as a variant of the one shown in FIG. 4.

FIG. 5 shows an alternative embodiment according to the inventive subject matter. Similar to the embodiment shown in FIG. 4, the pocket 100 have two cradles (150*a*, 150*b*) and two corresponding retainers (160*a*, 160*b*). In this embodiment, the first end (162*a*, 162*b*) of each retainer (160*a*, 160*b*) is respectively connected to a corresponding first anchor area (170*a*, 170*b*). As shown, the two retainers (160*a*, 160*b*) can have two separate first anchor areas (170*a*, 170*b*), instead of sharing the same first anchor area 170 as shown in FIG. 4. In addition, two user graspable elements (166*a*, 166*b*) can be attached to the first ends (162*a*, 162*b*) of the corresponding retainers (160*a*, 160*b*). Thus, by pulling the respective user graspable element (166*a*, 166*b*), the first end (162*a*, 162*b*) of the corresponding retainer (160*a*, 160*b*) can be attached to or detached from the corresponding first anchor area (170*a*, 170*b*) independently.

Although not shown, the pocket 100 can have more than two cradles, each of which can have a corresponding retainer and other associated structural elements, under the same principle as illustrated in FIGS. 4-5 and described above.

Figure 6A:
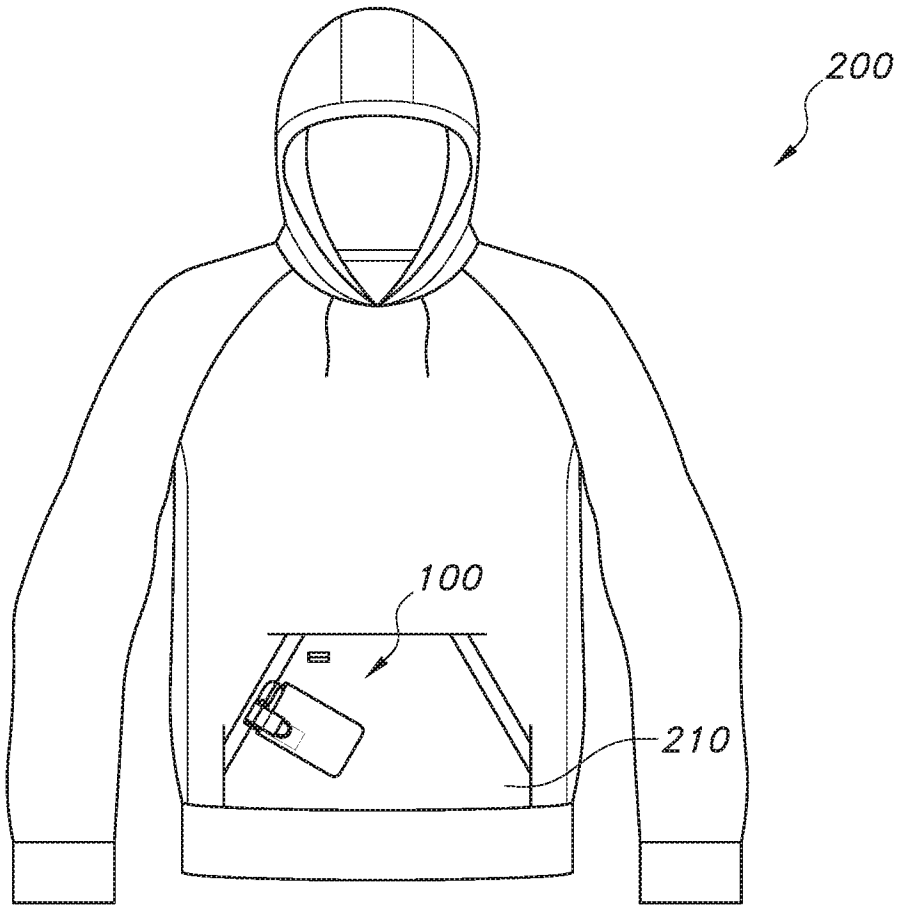
FIG. 6A shows a garment having a kangaroo pocket.

In a representative, non-limiting embodiment, the pocket 100 described above can be concealed inside another pocket ("host pocket") in the garment. As an example, FIG. 6A shows a garment 200 having a pocket 100 that is concealed inside a kangaroo pocket 210. The kangaroo pocket 210 can be large enough to fit both hands into, and can have opening on both sides. Other types of pockets, such as the patch pocket, welt pocket, etc., can also be used to conceal the pocket 100 based on the same principle described herein. Although the concealed pocket 100 is shown to have a particular angle of incline, it should be understood that the degree of incline for the concealed pocket can vary between about 0 degree (i.e., horizontal) and about 90 degree (i.e., vertical) based on design.

Figure 6B:
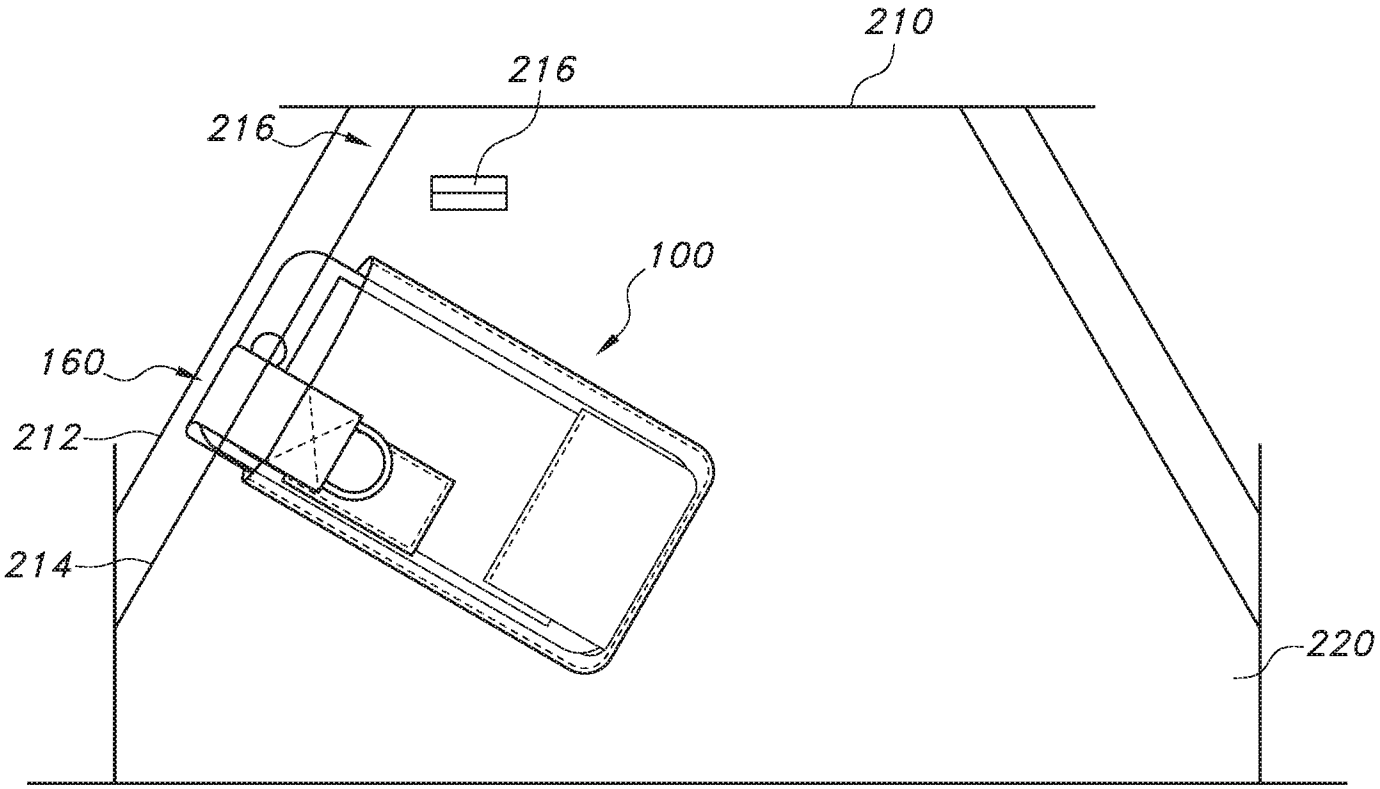
FIG. 6B shows a media pocket concealed inside the kangaroo pocket shown in FIG. 6A.

FIG. 6B shows the concealed pocket 100 inside the kangaroo pocket 210 with the garment 200 omitted for purposes of clarity. In this example, the kangaroo pocket 210 is sufficiently large to hold the compartment 110 of the pocket 100, and has an opening 216 that is at least as wide as the top opening 125 of the pocket 100. The opening 216 of the kangaroo pocket 210 can be formed between a front panel 214 and a rear panel 212. The front panel 214 and the rear panel 212 can be a unitary piece, or separate pieces of fabric. The pocket 100 can be attached to inside surface of the front panel 214 or the rear panel 212, for example, by means of sewing seams. In certain embodiments, the pocket 100 is positioned to be generally center near the opening 216 of the kangaroo pocket 210. In other embodiments, the position of the pocket 100 can be shifted upward or downward along the opening 216 of the kangaroo pocket 210. In some embodiments, the top opening 125 of the pocket 100 can be recessed from the opening 216 of the kangaroo pocket 210. For example, the top opening 125 of the pocket 100 can be spaced about 1.5 inch inside from the opening 216 of the kangaroo pocket 210. In certain embodiments, the kangaroo pocket 210 can have one or more welt openings 216 (or other types of small openings) that can be adapted to receive a cable. For example, a cable connecting at one end to an earphone or a battery charger that is outside the kangaroo pocket 210 may be inserted through one of the welt openings 216 into the kangaroo pocket 210. The other end of the cable can be further inserted through one of the channels 112 located on the concealed pocket 100 and connected to the smartphone stored therein.

Although only one concealed pocket 100 is shown in FIGS. 6A-6B, it should be understood that the garment 200 can have more than one concealed pockets 100. In some embodiments, two or more pockets 100 can be concealed in the same host pocket, e.g., two concealed pockets 100 can be placed inside the same kangaroo pocket 210 near the left and right openings, respectively. In another embodiment, each pocket 100 can be concealed in a separate host pocket located at different areas of the garment 200.

Persons skilled in the art will recognize that many modifications and variations are possible in the details, materials, and arrangements of the parts and actions which have been described and illustrated in order to explain the nature of the inventive subject matter, and that such modifications and variations do not depart from the spirit and scope of the teachings and claims contained therein.

All patent and non-patent literature cited herein is hereby incorporated by references in its entirety for all purposes.

Directions and other relative references, e.g., top, bottom, front, rear, left, right, upper, lower, etc., may be used to facilitate discussion of the drawings and principles herein, but are not intended to be limiting. For example, certain terms may be used such as "up," "down," "horizontal," "vertical," "anterior," "posterior," "lateral," "medial," and the like. Such terms are used, where applicable, to provide some clarity of description when dealing with relative relationships, particularly with respect to the illustrated embodiments. Such terms are not, however, intended to imply absolute relationships, positions, and/or orientations. As used herein, "and/or" means "and" or "or", as well as "and" and "or". Moreover, any and all patent and non-patent literature cited herein is hereby incorporated by references in its entirety for all purposes.

The principles described above in connection with any particular example can be combined with the principles described in connection with any one or more of the other examples. For example, the pocket described above can also be adapted to be integrated in backpacks, luggage, bags, briefcases, purses, and other articles that can be used for storage of personal belongings. Accordingly, this detailed description shall not be construed in a limiting sense, and following a review of this disclosure, those of ordinary skill in the art will appreciate the wide variety of systems that can be devised using the various concepts described herein. Moreover, those of ordinary skill in the art will appreciate that the exemplary embodiments disclosed herein can be adapted to various configurations without departing from the disclosed principles.

The previous description of the disclosed embodiments is provided to enable any person skilled in the art to make or use the disclosed innovations. Various modifications to those embodiments will be readily apparent to those skilled in the art, and the generic principles defined herein may be applied to other embodiments without departing from the spirit or scope of this disclosure. Thus, the claimed inventions are not intended to be limited to the embodiments shown herein, but are to be accorded the full scope consistent with the language of the claims, wherein reference to an element in the singular, such as by use of the article "a" or "an" is not intended to mean "one and only one" unless specifically so stated, but rather "one or more".

All structural and functional equivalents to the elements of the various embodiments described throughout the disclosure that are known or later come to be known to those of ordinary skill in the art are intended to be encompassed by the features described and claimed herein. Moreover, nothing disclosed herein is intended to be dedicated to the public regardless of whether such disclosure is explicitly recited in the claims. No claim element is to be construed as "a means plus function" claim under US patent law, unless the element is expressly recited using the phrase "means for" or "step for".

The inventors reserve all rights to the subject matter disclosed herein, including the right to claim all that comes within the scope and spirit of the following claims:

The invention claimed is:

1. A pocket for a garment comprising:

a compartment having a top opening, two opposing sidewalls comprising a first sidewall and a second sidewall, and a bottom wall;

a cradle having a first side that is coupled to the first sidewall, a second side that is coupled to the second sidewall, and a support portion between the first side and the second side that is disposed in the compartment between the first and second sidewalls and configured to receive and support an item storable in the compartment;

a retainer having opposing first and second ends attached to corresponding first and second anchor areas on the respective first and second sides of the compartment, at least the first end being detachable from the first anchor area, and when both opposing ends are attached to their corresponding anchor areas, the retainer spans at least a portion of the top opening of the compartment so as to be able to retain the item in the compartment; and a sleeve that covers at least a portion of the second sidewall, and the second side of the cradle is movably positioned between the sleeve and the second sidewall;

wherein the support portion of the cradle is movable from a first raised, unbiased position in the compartment to a second recessed, biased position in the compartment so that when the item is supported in the cradle in the second position, an ejection force is applied to the item when the first end of the retainer is detached from the first anchor area, causing the cradle to move toward the first position, lifting the stored item so that it is at least partially exposed from the top opening of the compartment; and wherein the sleeve has a lower end that is spaced from the bottom wall at a height corresponding to the first position in the compartment.

2. The pocket of claim 1, wherein the cradle comprises a sheet of one or more plies of elastic material.

3. The pocket of claim 1, wherein the cradle comprises one or more straps or cords of elastic material.

4. The pocket of claim 1, wherein at least a portion of the cradle has a net or mesh structure.

5. The pocket of claim 1 wherein the support portion of the cradle rests against at least a portion of the bottom wall when the cradle is in the second position.

6. The pocket of claim 1, wherein the first side of the cradle has a joint with the first sidewall and the joint is spaced from the bottom wall at about a height corresponding to the first position in the compartment.

7. The pocket of claim 1, wherein the second anchor area is located on the second side of the cradle.

8. The pocket of claim 1, wherein the retainer comprises an elastic material.

9. The pocket of claim 1, wherein the retainer has a body portion between the first end and the second end, wherein the body portion has an adjustable length.

10. The pocket of claim 1, wherein the first anchor area has a plurality of anchor locations, and the first end of the retainer can be detachably attached to the first anchor area through any of the plurality of anchor locations.

11. The pocket of claim 1 further comprising one or more channels or ports for an electronic interface disposed on any of the opposing sidewalls, the bottom wall, and any joint formed between the sidewalls and the bottom wall, wherein each of any such channels is adapted to receive a cable inserting from outside the compartment and being connectable to the item stored inside the compartment.

12. The pocket of claim 1 is disposed inside another pocket in the garment.

13. The pocket of claim 1, wherein the first end of the retainer is connected to a user graspable element.

14. The pocket of claim 1 further comprising:

two or more cradles, each cradle having at least a support portion disposed in the compartment, and the cradles are configured to receive and support the stored item; and two or more retainers, each retainer having opposing first and second ends attached to corresponding first and second anchor areas on opposite sides of the compartment, at least one of the opposing ends being detachable from the corresponding anchor area, and when both opposing ends of one of the retainers are attached to their corresponding anchor areas, the retainer spans at least a portion of the top opening of the compartment so as to be able to retain the item in the compartment;

wherein the support portion of each cradle is movable from the first position to the second position so that when the item is supported in the cradles in the second position, an ejection force is applied to the item when one of the opposing ends for each of the retainers is detached from the corresponding anchor area, causing the cradles to move toward the first position, lifting the stored item so that it is at least partially exposed from the top opening of the compartment.

15. The pocket of claim 14, wherein the first end of each retainer is connected to a user graspable element.

16. The pocket of claim 14, wherein each respective cradle has a corresponding sleeve that is coupled to the second sidewall, so that the second side of each respective cradle can be movably positioned between the corresponding sleeve and the second sidewall.

17. A garment comprising at least a panel of fabric and a pocket attached to the fabric, wherein the pocket comprises:

a compartment having a top opening, two opposing sidewalls comprising a first sidewall and a second sidewall, and a bottom wall;

a cradle having a first side that is coupled to the first sidewall, a second side that is coupled to the second sidewall, and a support portion between the first side and the second side that is disposed in the compartment between the first and second sidewalls and configured to receive and support an item storable in the compartment;

a retainer having opposing first and second ends attached to corresponding first and second anchor areas on the respective first and second sidewalls of the compartment, at least the first end being detachable from the first anchor area, and when both opposing ends are attached to their corresponding anchor areas, the retainer spans at least a portion of the top opening of the compartment so as to be able to retain the item in the compartment; and a sleeve that covers at least a portion of the second sidewall, and the second side of the cradle is movably positioned between the sleeve and the second sidewall;

wherein the support portion of the cradle is movable from a first raised, unbiased position in the compartment to a second recessed, biased position in the compartment so that when the item is supported in the cradle in the second position, an ejection force is applied to the item when the first end of the retainer is detached from the first anchor area, causing the cradle to move toward the first position, lifting the stored item so that it is at least partially exposed from the top opening of the compartment; and wherein the sleeve has a lower end that is spaced from the bottom wall at a height corresponding to the first position in the compartment.

18. The garment of claim 17, wherein the pocket is disposed inside another pocket in the garment.

19. A method of making a pocket on a garment, the method comprising:

selecting a panel of fabric on the garment and disposing the pocket on the selected panel of fabric;

wherein the pocket comprises:

a compartment having a top opening, two opposing sidewalls comprising a first sidewall and a second sidewall, and a bottom wall;

a cradle having a first side that is coupled to the first sidewall, a second side that is coupled to the second sidewall, and a support portion between the first side and the second side that is disposed in the compartment between the first and second sidewalls and configured to receive and support an item storable in the compartment;

a retainer having opposing first and second ends attached to corresponding first and second anchor areas on the respective first and second sidewalls of the compartment, at least the first end being detachable from the first anchor area, and when both opposing ends are attached to their corresponding anchor areas, the retainer spans at least a portion of the top opening of the compartment so as to be able to retain the item in the compartment; and a sleeve that covers at least a portion of the second sidewall, and the second side of the cradle is movably positioned between the sleeve and the second sidewall;

wherein the support portion of the cradle is movable from a first raised, unbiased position in the compartment to a second recessed, biased position in the compartment so that when the item is supported in the cradle in the second position, an ejection force is applied to the item when the first end of the retainer is detached from the first anchor area, causing the cradle to move toward the first position, lifting the stored item so that it is at least partially exposed from the top opening of the compartment; and wherein the sleeve has a lower end that is spaced from the bottom wall at a height corresponding to the first position in the compartment.

* * * * *